United States Patent [19]

Holland, Jr.

[11] 4,216,929

[45] Aug. 12, 1980

[54] KITES

[75] Inventor: Raymond P. Holland, Jr., Roswell, N. Mex.

[73] Assignee: The Holland Corporation, Roswell, N. Mex.

[21] Appl. No.: 925,500

[22] Filed: Jul. 17, 1978

[51] Int. Cl.[2] ..... B64C 31/06

[52] U.S. Cl. ..... 244/153 R; D21/88

[58] Field of Search ..... 244/153 R, 155 A, DIG. 1, 244/16; D21/88–90; D12/71

[56] References Cited

U.S. PATENT DOCUMENTS

| | | | |
|---|---|---|---|
| D. 196,057 | 8/1963 | Levine | D21/88 |
| 1,105,058 | 7/1914 | Bochau | 244/153 R |
| 1,927,835 | 9/1933 | Kellogg | 244/154 |
| 3,347,500 | 10/1967 | Hartig | 244/153 R |
| 4,015,801 | 4/1977 | Womble et al. | 244/145 |
| 4,103,850 | 8/1978 | Bushell | 244/153 R |

*Primary Examiner*—Galen L. Barefoot

[57] ABSTRACT

A keel kite is disclosed having an increased range of flight speeds and an improved ability to withstand gusty winds, consisting of a mass-balanced sail portion eliminating the center line spar either entirely or over the rear central portion of the sail, and a separately mass-balanced keel portion supported by a spar along its lower edge, aerodynamically balanced, able to pivot somewhat in yaw, and employing an adjustable trimming surface.

6 Claims, 12 Drawing Figures

KITES

The present invention relates to a keel kite of unique construction having a reinforced keel of generally quadrilateral form, this kite being able to fly in stronger and gustier winds than is possible with keel kites of existing construction.

The invention is well suited for use on the class of keel kites known as delta wing kites. In the descriptions which follow the principal attention will be directed to delta wing kites, but the invention is not limited to kites of that class.

The keel kite is currently being manufactured and sold in larger quantities than any other style, despite certain faults. On the keel kite, as on many other efficient types of kites, differences of stiffness between the two structural wing spars on opposite sides of the kite cause lateral mistrim, causing the kite to fly to one side, toward the side of the soft wing spar. This effect becomes larger as wind speeds and structural deflections increase, until the kite is forced down.

In low cost kites this structural dissymmetry has been corrected by the use of plastic wing sticks, which have greater structural uniformity than natural wood. However, such plastic sticks are heavier and structurally much softer than wooden sticks, with the result that kites using plastic sticks, being heavier, cannot fly in as light a wind, and being more pliable, cannot fly in as strong a wind as a comparable kite using wooden sticks. The typical mass-produced keel kite using plastic sticks starts fluttering and flapping, unable to stay airborne, when the wind reaches about fifteen miles per hour. This is an unsatisfactory performance, the correction of which offers a considerable economic incentive.

An alternative correction of structural dissymmetry using stiff, light weight wing spars, such as wooden sticks or aluminum alloy tubing, accurately matched for symmetry, adds to the manufacturing cost of a kite, and it does not correct other faults of the delta wing kite. An aerodynamically clean delta wing kite responds to sudden changes of wind velocity or direction with such suddenness and force that it is typically unable to recover dynamically from its own spurt of velocity. If stabilized, it tends to pull excessively. If trimmed to reduce pull, it tends to dip down and forward in downgusts, to slacken the flying line, depriving the kite flyer of all control, and to dive to earth. Many delta wing kites flap and flutter excessively. It is the broad object of this invention to correct these difficulties.

More specifically, the objects of this invention are as follows:

To improve the flight performance and stability of keel kites of all varieties; to enable them to fly in a wider range of wind conditions, including lighter winds, stronger winds, and gustier winds, and to provide them with adequate trimming capability to overcome dissymmetries in the individual kite.

To permit the construction of the structural wing spars of keel kites using wood of a quality readily available commercially, insensitive to the variations in physical properties found in such wood, but benefiting from the relatively light weight and high stiffness of wood as compared to plastics.

To give the designer of keel kites a wider latitude of choice in those elements of design which affect kite response to adverse and irregular flight conditions.

To be able to use the design latitude so gained to produce aerodynamically clean keel kites of high performance and reliable uniformity of flight for modern all-weather uses, such as monitoring of wind speeds and directions near airports, detection of airborne pollutants, continuous flight for meteorological purposes, and for the lifting of payloads.

To gain these advantages while retaining simple, light weight, inexpensive construction suitable for competitive commercial manufacturing and sales.

In the drawing:

FIGS. 1, 8, and 11 show kites of this invention in flight. Views of each of these kites as seen from above are shown in FIGS. 2, 9, and 12, respectively.

Figure 6:
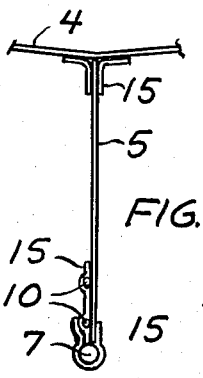
Figure 2:
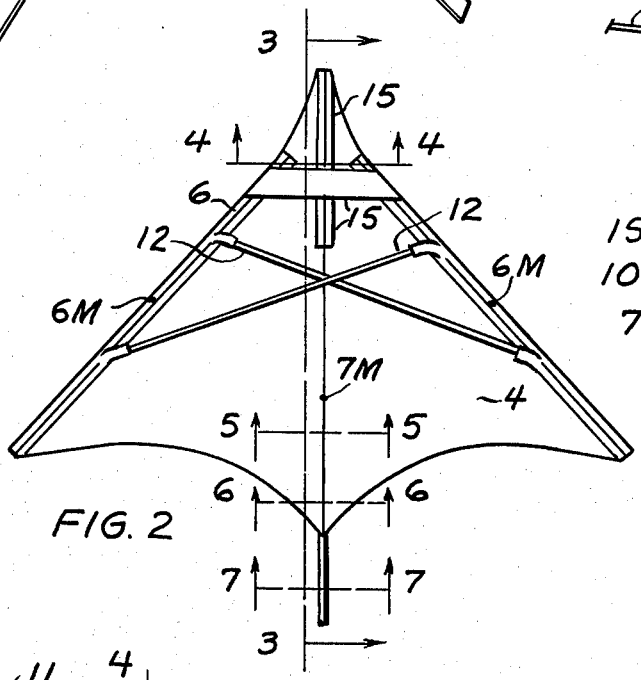
Figure 7:
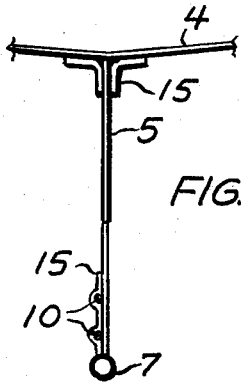
Figure 3:
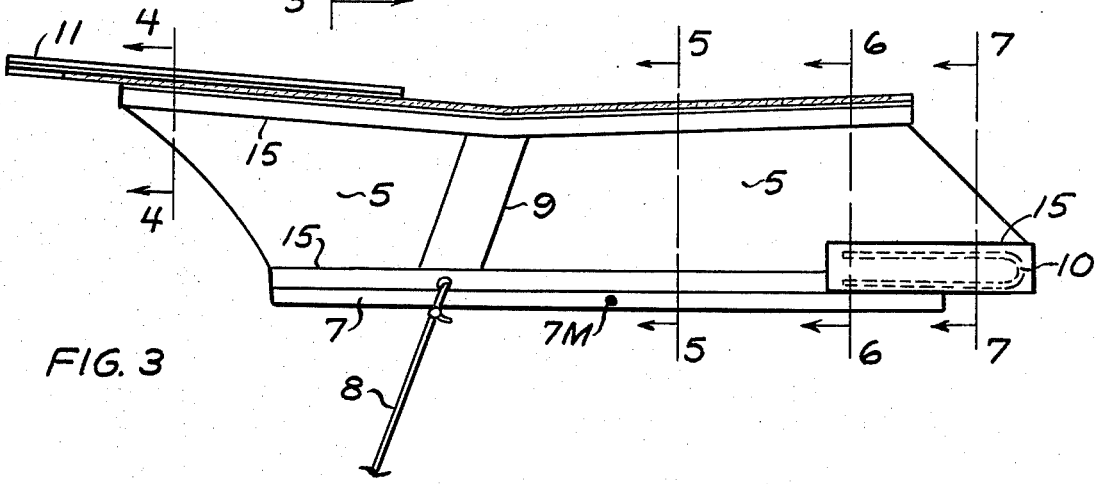
FIG. 3 is an enlarged side view of the keel taken at section 3—3 of FIG. 2.
Figure 8:
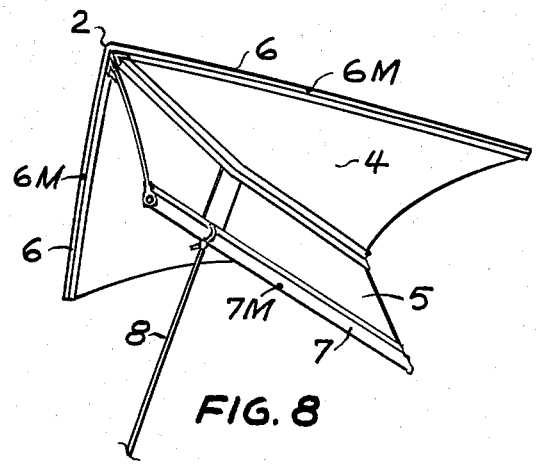

FIGS. 6 and 7 are views taken at sections through the keel at sections 6—6, and 7—7, respectively, on FIGS. 2 and 3.

Figure 9:
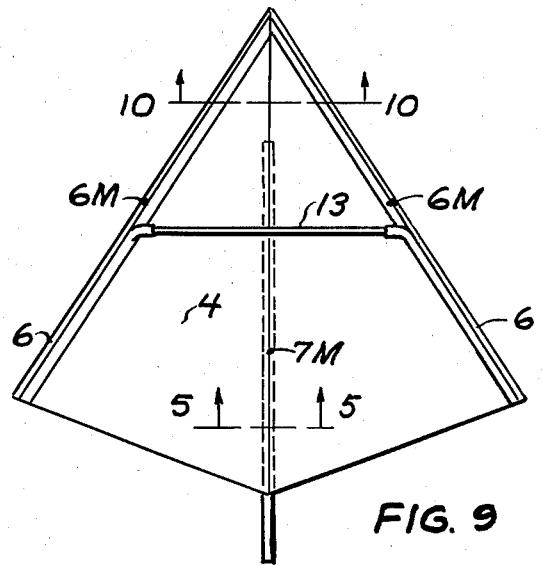
Figure 10:
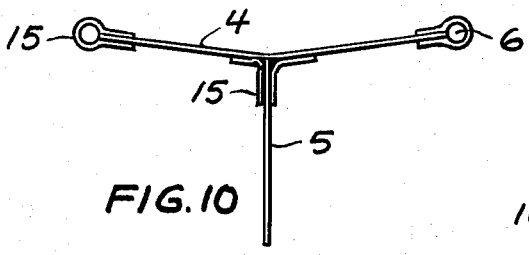
Figure 12:
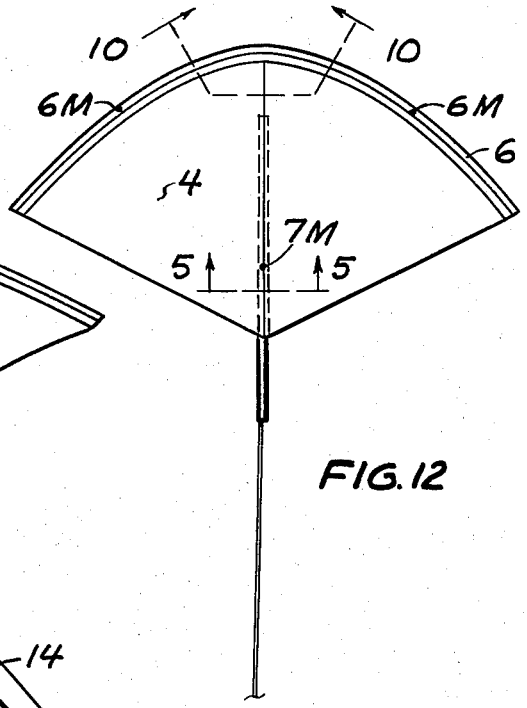

FIG. 10 is a section taken at 10—10 on FIGS. 9 and 12.

The type of kite under discussion is normally flown without a trailing tail. Therefore, it must obtain its sense of the vertical direction by the action of gravity on its airframe. This requires a center of gravity position somewhat rearward of the aerodynamic center of the lifting surface. However, there are basic stabilization difficulties with such a rearward location. It increases the frequency and decreases the amplitude of the most serious oscillations which the kite experiences. Typically, such a kite, if not correctly stabilized, streaks sidewardly, dips down, and makes a series of tight loops as it loses altitude. The use of a sufficient amount of aerodynamic drag to absorb the excess energy of these motions is not permissible; it violates the requirement that the kite be aerodynamically clean.

In a steady wind of moderate speed the conventional keel kite does not experience these difficulties. The rearward center of gravity causes the relatively rearward portions of the kite to hang earthward, thereby directing the kite upwardly away from the earth. This stabilization is lost when a strong gust strikes or an oscillation occurs; the dynamic forces due to the acceleration and rotation of the kite act at the center of gravity in different directions than the earthward pull of the force of gravity. Yet it is only by the force of gravity, equal to the small weight of the kite, acting on the kite at its center of gravity that the kite can sense the presence of the earth and respond by flying in the opposite direction. When that force becomes obscured because of substantial forces in non-vertical directions, the kite loses its ability to recover stabilized climbing flight.

The problem is complicated by the fact that a kite having a center of gravity sufficiently rearward to sense gravity and fly upward is statically unstable except for the moments exerted on the kite by the string tension. The kite would immediately diverge from its position of equilibrium if string tension were removed.

In the past the problem of stabilization has been further complicated by the fact that every kite has a relatively flexible structure.

The solution to these problems of kite equilibrium is obtained in the present invention, together with the solution of several other difficulties which will become apparent in the discussion which follows, by the use of a two-part dynamic system each part of which has its own characteristic response. The flexible structure of the kite, ordinarily a disadvantage for stabilization, is used to obtain this two-part dynamic system.

The two essential force-generating parts of the dynamic system consist of an upper part, the sail, and a lower part, the keel. Each of these two parts, together with its stiff supporting members, has its own mass, moments of inertia, center of gravity, and is acted on by its own primary aerodynamic forces and it has its own characteristic responses. The dominant aerodynamic forces act in mutually perpendicular directions on the two parts. Each is a dynamic subsystem, the combined effect of which, varying according to intensity, abruptness, frequency, and directions of loading, determines the responses of the kite as a whole.

The actions of the twp-part dynamic system are especially important in coping with the disturbances caused by the strongest, gustiest winds inflicted on kites of the lightest weight. The two-part system reacts differently to abrupt transient changes and to gradual persistent changes. The problems occur largely due to a very strong and abrupt change of aerodynamic loading. The responses of the two parts at the first instant are especially important. In transient conditions, the kite responds as if it had a relatively forward center of gravity; and in the gentler more persistent situations, it acts as if it had a relatively rearward center of gravity.

The major aerodynamic forces on the kite are generated by the sail. Primarily, it is the sail which must be stabilized. To obtain stabilization in severely gusty wind of high strength, a relatively forward center of gravity is needed. To accomplish this, the rigid structure supporting the sail, in which most of the mass occurs, is located well forward. Little or no support is used rearward of the leading edge of the sail. As a result, the sail itself (ignoring the effect of the keel) is statically stable, aerodynamically. It will not diverge when it encounters a gust, and it tends to shed sudden loads by aerodynamic weathervaning. This action is assisted by the relatively stiff forward portion of the sail and the relatively flexible and yielding rearward portion allowing loads to be shed by structural twisting.

The other part of the two-part dynamic system, the lower part, the keel and its attached structure, having a smaller area and a much smaller aspect ratio than the sail, encounters smaller aerodynamic forces. Since the kite as a whole must have a slightly rearward center of gravity, and since the upper portion now has a relatively forward center of gravity, it is necessary to place the center of gravity of the keel well rearward. This is accomplished by attaching a rigid structural member along the bottom edge of the keel extending rearward sufficiently to accomplish the correct balance for the kite as a whole.

Conventional kites of the type closest to those of the present invention employ triangular keels attached to the sail along a central body spar. In concept, to convert this conventional kite to a kite of this invention, the triangular keel would be changed to a flat-bottomed keel of roughly quadrilateral shape extending well aft and a keel support beam would be attached along its bottom edge. For best results, at least the rear portion of the central body spar of the conventional kite would be eliminated. This change produces several synergistic advantages and opportunities, as described below:

Downgusts

When the conventional keel kite, trimmed in pitch by string tension acting at a low point on the keel, having a center of gravity located rearward of the aerodynamic center of the sail, flying with the line initially taut, encounters a severe downgust, the downwardly acting aerodynamic force due to the gust acts forward of the center of gravity of the sail and causes the sail to pitch nose downwardly. This in turn causes the aerodynamic down force to increase. The string slackens, and the conventional kite dives and flutters down, entirely beyond any remedial action by the kite flyer.

With the two part system of the present invention, in the same circumstances, strikingly different results occur. When the downgust strikes the sail, the aerodynamic reaction now occurs rearward of the center of gravity of the sail, because the sail's center of gravity has been moved forward of its aerodynamic center. Consequently, the sail rotates nose up in the direction to regain lift. Although the keel has a rearward center of gravity, the presence of the keel has no effect upon the action of the sail. The only force available to accelerate the keel downwardly is that force already present in the tension of the flying line when the downgust strikes. Since the surface material of the keel is flexible, the temporary downward motion of the upper sail is not transmitted through the keel material.

The result is opposite from that for the conventional kite. The kite continues to fly with a taut line. No matter how sudden or severe the gust, that is the result. And if the gust is not severe, there is no problem, because in that case the corrective action of string tension alone is adequate. The result: the kite of this invention cannot be forced down by a downgust.

In practical use it is not essential that the center of gravity of the sail be forward of the aerodynamic center. A position on the aerodynamic center eliminates nose down pitching, and a position close to the aerodynamic center reduces nose down pitching to amounts tolerable in typical gusts. To the same degree that the center of gravity of the sail is located forward of the center of gravity of the kite as a whole, corrective action will occur.

Upgusts

Recognizing that this invention causes the effect of a downgust to be neutralized or reversed, we must consider the effect of an upgust, because reversal of an upgust would be undesirable, as it would cause the kite to dive.

At the first instant when an upgust strikes a kite embodying this invention, the sail does tend to nose down, in a direction opposite to the conventional response. However, in order to nose down, rotating around the center of gravity of the sail, the center of gravity of the keel must be accelerated upward. The entire sail is rising and the tension in the material of the keel unyieldingly connects the keel support beam into the dynamic system. In the upgust, then, the rotation of the entire kite occurs around the more rearward center of gravity point corresponding to that for the entire kite structure. Therefore, the kite noses up. This is the desired response.

Whether a gust strikes from below or above, the kite of this invention either rides steady or noses up. Diving is avoided.

Sideward Gusts

In sidewardly acting gusts, or in curving flight, or whenever the kite is sharply accelerated sidewardly, the differences in the fore and aft positions of the centers of gravity of keel and sail have beneficial effects. With the conventional keel kite, the mass acceleration reaction due to a sidegust causes an unstable yawing moment around a relatively rearward center of gravity, intensifying the effect of the gust. With this invention the same gust causes instantaneous stable weathervaning around the relatively forward center of gravity of the sail, reducing the effect of the gust. The action of the keel is opposite, but the aerodynamic forces on the keel are smaller, so that the sail dominates the result.

In sideward acceleration, in this invention, the sail and keel twist somewhat relative to each other, taking somewhat different headings in yaw. This is permitted by the flexible structure which employs no rigid member along the line of juncture of sail and keel near the rear of the sail, and by the keel construction which produces an effective pivot axis for the keel along the line of flying string tension.

The difference of heading of keel and sail, during the brief duration of a lateral disturbance, has a moderating effect. The transient changes of aerodynamic forces tend to cancel each other and a temporary increase of induced drag absorbs energy and helps snub the motion.

Lateral Oscillations

An aerodynamically clean conventional keel kite when flown on a short line of one particular length, in one particular wind speed, has a tendency to display its energetic nature by rushing from side to side, gaining excessive speed near the end of its sweep, and diving to earth. Patient design adjustments, by changing the keel area and the fore-and-aft position of the string tie point may prove ineffective to correct this tendency. Immediate and dramatic correction, on the other hand, has been achieved experimentally by removing the rear portion of the central body stick of the conventional kite and using it to support the bottom edge of a quadrilateral keel extending well rearward, as taught by this invention.

In lateral oscillations, the relatively rearward center of gravity of the sail of the conventional keel kite tends to drive the oscillation, by causing the rear of the kite to swing out wider than the nose, driving the kite with increased speed back toward the neutral position of the oscillation. With this invention, the more forward center of gravity of the sail markedly reduces this action.

Center of Gravity Positions

The kite designer now has wider latitude in balancing the kite. He may successfully use an overall center of gravity more forward or more rearward than is suitable for conventional keel kites.

Keel Geometry

The geometry of the conventional triangular keel is largely determined in all its dimensions when a few key dimensions have been selected. With the quadrilateral keel, on the other hand, the keel may be made shallower or deeper, or of greater or smaller area, or with more area relatively forward or with more area rearward according to the needs, each of these choices being independent of the others.

Different conditions of kite flight require different keel actions; these cannot be adequately accommodated using the conventional triangular keel.

For example, the large amount of keel area required for stabilization when the kite is flying at a high angle above the horizon typically causes an excessive amount of keel depth for the condition when the kite is just rising from the ground. As a result, the kite tends to pull excessively during its climb. With a quadrilateral keel, area may be made ample; and the keel depth may be reduced so that the flight of the kite is moderate and stable at all times.

Many of the problems of stabilization of the conventional aerodynamically clean keel kite are due to excessive reaction to the tension of the string, due in turn to a keel depth which is greater than actually needed. The conventional kite, consequently, has a relatively small range of acceptable keel geometries. If the tie point on the keel is too far rearward, the kite pulls too hard. If the tie point is too far forward, the kite tends to flutter and dip downwardly. If the kite designer wishes to change the keel of the conventional kite, he changes not only the one variable which he needs to change, but he must change others as demanded by the limitations of available triangular keel shapes. In this way a minor improvement may be accompanied by a major difficulty. With the kite of the present invention, on the other hand, the designer may change one design variable at a time. For example, the string tie point may be moved forward or rearward without any changes in the geometry of the kite. This is not possible with a triangular keel.

The Free Keel

When the conventional kite is flying with one wing tip lower than the other, stabilizing action occurs by means of the rearward center of gravity of the entire kite which causes the nose of the kite to yaw toward the side of the high wing. With the present kite using the quadrilateral keel, it is not necessary for the entire kite to yaw. Rotations of the main sail, with accompanying changes of forces, are reduced. The keel itself, with its markedly rearward center of gravity and its relative freedom in yaw, performs the primary yawing action, acting automatically like a movable control surface on an airplane. This produces a side force on the keel acting toward the high wing, which corrects the flight position, with a reduced risk of instability.

During testing of the kite of the present invention, the above effect was demonstrated. Two identical configurations were used, the only difference being that the center of gravity of the keel was rearward in one case, and the center of gravity of the sail was rearward in the other case. The fore and aft position of the center of gravity of the kite as a whole did not change. This was accomplished by transferring small weights between the keel and the sail. With the weights on the rear of the keel, the kite in gusty air repeatedly recovered normally from a sideward position. With the weights on the sail, on the other hand, the kite repeatedly did not recover but yawed nose earthward and dove to the ground.

Keel Pivoting and Aerodynamic Nose Balance

By concentrating the tension in the keel material in the region just above the string tie point, an effective pivot axis for the keel is created. The area forward of the pivot serves as an aerodynamic nose balance which enables the keel to rotate more readily than would otherwise be the case. The freedom of the keel to yaw is facilitated by the absence of any center line spar member at the rear of the sail. By these means, the action of the rearward center of gravity causes a greater deflection of the keel than would otherwise occur; and the keel stabilization action is magnified. Only very small angles of keel deflection are required in these actions.

Keel Trimming

A small trimming surface at the rear of the pivoting keel is used to cause the kite to trim either to the right or to the left, that is, to elevate the left wing or to elevate the right wing, respectively. Trimming action is used in this way to trim out unavoidable lateral dissymmetries of the kite.

Lift Equalization

With this invention, in flight, when one wing spar is structurally softer than the other, its rearmost end bends more toward the center of the kite than the opposite wing spar, pulled in that direction by the tension in the pliable material of the sail. Since there is no body spar along the center of the sail in its rearward region, the tension forces from the two sides of the billowing sail and the tension force from the keel balance each other at all the points along the line of juncture between the keel and the sail. This line of juncture, as seen from above, will be a straight line if the sail is symmetrical and the two wing spars are of equal bending stiffness. But if the wing spar on the right, for example, is relatively soft, its rearward tip will be bent more to the left than its opposite counterpart will be bent to the right. The rear of the sail will then shift to the left at the line of juncture between the two halves of the sail with the greatest shift occurring at the trailing edge, and the flexible material of the keel attached to that line of juncture will bend with its rearward end to the left. This bend will produce an aerodynamic yawing moment in a direction to move the right wing forward. The action of dihedral will then increase lift on the right wing and decrease lift on the left wing. This is the desired corrective action.

This action reduces the sensitivity of the kite to differences of structural stiffness in its wing spars. Ordinarily, a soft wing spar causes lift to be lost on the wing which that spar supports. But this action restores lift on the soft wing.

This action cannot occur on a conventional keel kite. The conventional centerline body spar, even if free to swing sidewardly at its rear end, acts to enforce a straight line along the juncture of the two halves of the sail. A curved line is essential to produce an aerodynamic yawing moment. And if the centerline body spar were eliminated, the forward-acting component of tension from the triangular keel would collapse the sail by pulling its trailing edge forward, destroying its usefulness.

Referring now specifically to the drawing, three examples of the invention are shown.

In the description of these kites the "front" of the kite is the most forward point, and the lifting sail of the kite is to be considered for purposes of discussion to be generally horizontal. The upward direction is to be considered perpendicularly upward relative to the mean plane of the sail. The words "front", "rear", "forward", "rearward", "upward", "downward", "above", "below", "left", and "right" are all to be taken in a mutually perpendicular coordinate system of directions in which the sail approximates the horizontal plane, and "left" and "right" apply facing forward, toward the front of the kite.

Figure 1:
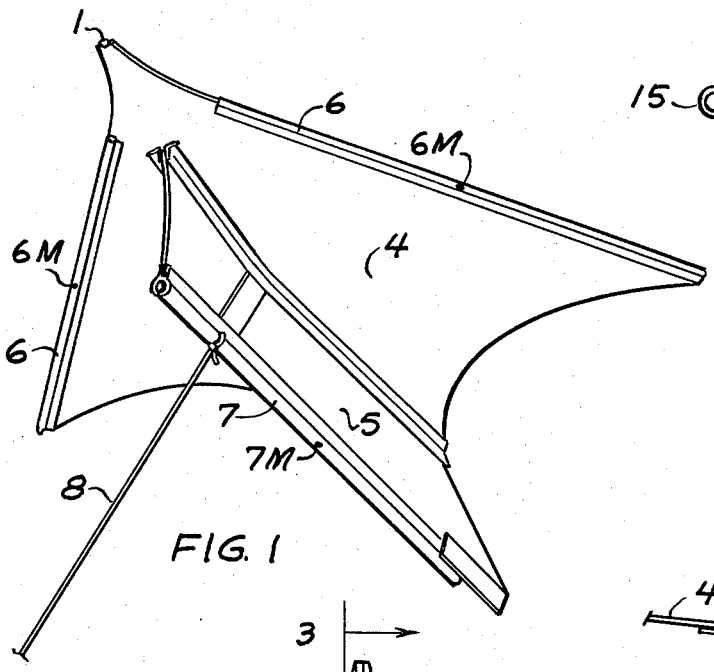

The three versions of the kite shown in FIGS. 1 and 2, and 8 and 9, and 11 and 12, respectively, differ from each other in their means of supporting the wing leading edge and in the use in kite 1 of FIGS. 1 and 2 of a short central forward spar member supporting the front of the kite. Kite 1 in FIGS. 1 and 2 employs spreaders which cross each other. Kite 2 and 3 of FIGS. 8 and 9, and 11 and 12, respectively, do not use a nose spar. Kite 3 of FIGS. 11 and 12 does not use a spreader.

No spar-like support is employed on any of the kites in the region of section 5—5 of FIGS. 2, 9, and 12 where conventional kites of this general type employ a full-length body spar.

Sail 4 of all three kites is a pliable, preferably drapable membrane such as a thin plastic sheet or cloth. Keel 5 is a sheet of similar material standing in a vertical fore and aft plane beneath sail 4 and attached along its upper edge to sail 4. By "keel" I mean this vertical surface 5, and I do not mean a central spar of the sail as the term "keel" is sometimes used. The shape of keel 5 is relatively shallow in the up and down direction and relatively long fore and aft. The general form is that of a quadrilateral. The upper edge of the keel is attached to sail 4 by means of soft, deformable adhesive tape. The top edge of the keel is not a straight line but is formed by two straight lines at a small angle to each other such that the overall form is concave upwardly.

Spar 6 supports the leading edge on all three kites for adequate support in high-speed winds when the kite is flying at a small angle of attack.

Figure 11:
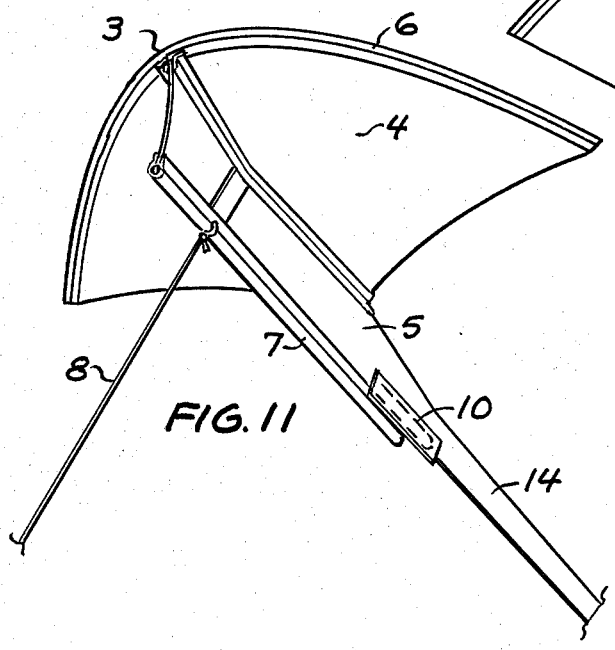

The central points of the length of each lateral side of spar 6 are shown on FIGS. 2, 9, and 12 at point 6M. Spar 6 on kite 3 of FIG. 11 is a continuous member running from wing tip to wing tip along a curved leading edge. Spar 6 in FIGS. 1 and 2, and 8 and 9, respectively, are straight members. The location of spar 6 on kites 1 and 2 of FIGS. 1 and 2, and 8 and 9, respectively, differ in that the forward inward ends of spar 6 meet at the front of kite 2 of FIGS. 8 and 9; whereas in kite 1 of FIGS. 1 and 2, the spars do not reach the forward end of the kite or the kite center line.

The positions of the sail-supporting spars in various kites have a dominant effect upon the location of the center of gravity of the sail which in turn affects the dynamic response of the sail in gusty winds.

Keel 5 is supported along its lower edge by stiff keel support beam 7. The center of its length is indicated on FIG. 3 and FIGS. 2, 9, and 12, at point 7M. On the latter figures, the relationship of points 7M to 6M may be seen. The center point of the keel beam 7M is always located more rearward than the center point 6M of the sail-supporting spar on one side of the kite.

Beam 7 may be located forwardly or rearwardly as desired to produce the correct balance, even extending beyond the limits of keel 5 if necessary.

Flying line 8 is tied to beam 7 at a single point forward of midpoint 7M and rearward of the front end of beam 7. The position of attachment may be conveniently altered forward or rearward without altering the geometry of the keel. The relatively rearward location of point 7M on the kite produces a center of gravity position of the keel more rearward and lower than the center of gravity position of the kite as a whole, and markedly more rearward and lower than the center of gravity position of the sail and its supporting spars.

When the kite flies with one wing tip lower than the other, gravity acts on beam 7 causing keel 5 to yaw, lowering its lower rearward end. This produces a keel angle of attack relative to the wind which produces aerodynamic forces on the keel surface and on the nearby surfaces of the sail to display the kite in the direction of the higher wing tip, and to roll the kite back toward the normal position of equilibrium with wings level. This action is generated by the rearward weight of beam 7. On conventional keel kites a stiff central spar member is employed running fore and aft along the center line of the sail entirely across the rearward portion of the sail, across the region of section 5—5 on FIGS. 2, 9, and 12, at least to the trailing edge of the sail. No such member is used on the present invention. In experimental flight testing in severe wind conditions with keel kites, the elimination of a stiff central spar from the rear of the sail and its relocation on the lower edge of a quadrilateral keel produced dramatic improvements in stability.

The central spar of conventional keel kites must not have any bend at its rear end toward one side or the other or the kite will be aerodynamically out of trim. The same imperfect spar transferred to the bottom of the keel is less sensitive to dissymmetry because the forces on keel surface 5 are smaller in absolute magnitude than the forces on sail surface 4, and any curvature which happens to exist in beam 7 on the keel is easily corrected by the action of bendable trimmer 10, shown on FIGS. 3 and 11 and described below. In addition, sail 4, relieved of the constraint of a central spar along its center line near its trailing edge, becomes free to balance itself laterally as the result of wind pressure so that the removal of the central spar facilitates the lateral balancing of the kite. Such lateral balancing becomes critical in strong winds so that this improvement yields major benefits.

In the "two-part dynamic system" described above, the "upper part" consists of sail 4 including leading edge spars 6 and any central nose spar 11, and any spreaders such as 12 or 13, and any other parts of significant mass which may be attached to sail 4. The "lower part" of that system consists of keel 5, beam 7, and any other parts such as trimmer 10 having significant mass attached directly to keel 5. In FIG. 3 it may be seen that any upward force applied by sail 4 to keel 5 is transmitted directly through the material of keel 5 in tension to beam 7, as if keel 5 were rigid. In the opposite direction, however, a downward force applied to said 4 cannot be transmitted to keel support beam 7 because of the flexibility of the material of keel 5. The only external force which can be applied to beam 7 in the downward direction comes from the tension of flying line 8.

The effect of the pliable material of keel 5 standing between the mass of the sail parts and the mass of the keel parts resembles a one-way valve. It transmits the effects of upgusts but does not transmit the effects of downgusts. The response of the kite, then, is as if it has a relatively forward center of gravity (that of the upper part) in the downgust, so that it tends to pitch nose-up; and as if it has a relatively rearward center of gravity (that of the upper and lower parts combined) in the upgust, so that in this case also, the kite pitches nose-up.

In FIG. 3 doubler 9 is a relatively reinforced but still flexible portion of the flexible material of keel 5. It is located along the line of reaction of the tension in flying line 8 where it carries a relatively large portion of the tension force from the flying line into sail 4. The upper end of doubler 9 is located in the region of the greatest upward concavity of the upper edge of keel 5, as may be seen in FIGS. 1, 3, 8, and 11. Keel 5 is narrow in depth at doubler 9, contributing to the same result of local stress increase. The functions of this construction are to provide an effective generally vertical axis around which keel beam 7 may jaw slightly, and to force the sail to take a form in flight, in the central area above the string tie point, somewhat concave upwardly.

The keel near doubler 9 is less free to move laterally than the more forward and rearward portions of the keel. In effect, a pivot axis is produced; the keel tends to yaw about a line in extension of the flying line. The keel then becomes a relatively free surface. The aerodynamic forces on the keel may be adjusted by design, by increasing or decreasing the area in forward or rearward locations. The weathervaning motions of the keel may be made statically stable, neutrally stable, or unstable. The area of the keel forward of doubler 9 serves the same function as the aerodynamic balance on a hinged aircraft control surface. Consequently, only a relatively small gravity moment from the weight of beam 7 acting a point 7M causes a relatively large angular displacement of beam 7. By this action, the aerodynamic leverage of the keel surface area is increased as needed and comes under the control of the designer.

Just as the tightness and looseness of the keel material is governed by the construction just described, tightness and looseness may be distributed in the sail material according to design. The upwardly concave contour of the upper edge of keel 5 and the presence of doubler 9 causes a relatively large amount of tension to enter the sail near the upper end of doubler 9. This causes the sail to take a somewhat concave shape on its upper surface in its central forward region. As the kite flies, this shape becomes established in deformable tapes 15 which are used to assemble the kite. A nose-up aerodynamic trimming tendency is produced in this way which maintains itself whenever the flying line goes slack. This happens when a light variable wind suddenly reverses direction. The nose-up trimming tendency then causes the kite to take a nose-high attitude and drift in the wind until tension on the flying line is resumed.

Trimmer 10 attached to keel surface 5 at its rearward extremity adjacent to the rear end of beam 7 consists of a thin metal wire in the general shape of a hairpin taped to the keel surface. Alternatively, a strip of adhesive tape of metal foil may be used. Trimmer 10 may be bent by hand at its rear end either to the right or to the left to produce a trimming action to cause keel 5 to align as required for trimming the entire kite. For exammple, if imperfections of symmetry in the kite cause it to fly with the flying line not vertical but sloping up to the right as seen by the kite flyer facing the kite, stiffener 10 may then be bent slightly to the kite flyer's left causing keel 5 to yaw around the pivot axis at doubler 9 with its forward end toward the desired vertical position of the flying line. The kite will then be steered back to its true vertical position. By such adjustments, residual unbalances of a kite may be corrected, enabling it to fly in very strong winds.

It is, of course, apparent that refinements of the present invention could employ a radio-controlled trimmer performing the function of trimmer 10 such that the position of the kite could be controlled at will from the ground or in fact a fully automatic control system could be applied.

Figure 4:
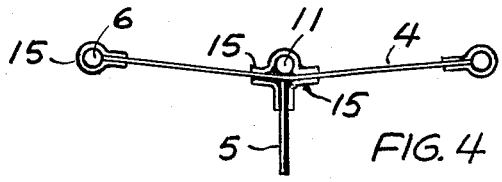
FIG. 4 is a section through the front of the kite of FIG. 1 located at section 4—4, on FIGS. 2 and 3.

Short central nose beam 11 is used in kite 1 as shown in FIGS. 2, 3, and 4, attached to the material of sail 4 by pressure sensitive tape 15. Keel 5 is also attached to sail 4 just below beam 11 by pressure sensitive tape 15. This tape deforms plastically in use so that beam 11 holds a nose-up angle corresponding to the forward top edge of keel 5 even when air pressures are briefly absent from sail 4. An upwardly planing effect, or nose-up trim, is produced in this way causing the kite to recover upwardly from any tendency to dip nose-down in conditions of slack flying line. The same action but to a smaller degree is achieved by kites 2 and 3 of FIGS. 8, 9, and 11, 12, respectively, which do not use beam 11 but depend solely on deformable tape for the result.

Figure 5:
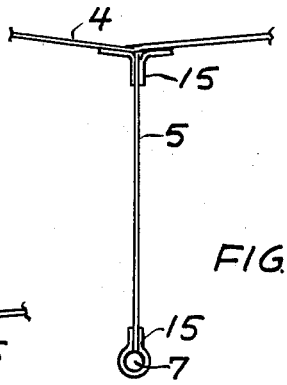
FIG. 5 is a section taken at 5—5 on FIGS. 2, 3, 9, and 12.

Beam 11 is used when leading edge spars do not support the extreme nose portions of the kite, or when needed to move the center of gravity of the sail forward. As shown in FIGS. 2, 3, and 4, beam 11 is limited to a region well forward on sail 4. Its absence in FIGS. 5 and 6 certifies to the absence of any such central beam rearward in the preferred construction of this invention. Any such beam running aft would move the center of gravity of the sail rearward, could introduce lateral unbalance into the aerodynamic form of the sail (as by a spar with a sideward bend in its rearward end), would impair equalization of the otherwise free-billowing sail material, and would prevent the automatic yawing action described above by means of which the lift on the kite is equalized laterally despite a relatively yielding wing spar on one side of the kite. This equalizing action is assisted by beam 11. It contributes to a relatively more rigidly held front end of the line of juncture between keel 4 and sail 5, thereby forcing that line of juncture to be curved, instead of straight, as seen from above, when the trailing edge of sail 4 shifts sideward due to bending softness of one of the wing sticks. It is this curve which produces the yawing moment which yaws the kite to lift the wing on the soft side, correcting the lateral unbalance, as previously described.

As shown in FIG. 2, beam 11 is used in conjunction with crossed spreaders 12, to keep the center of gravity of the sail forward while supporting leading edge spars 6 near their rearward outward tips, and in that way to reduce lateral dissymmetry of the kite structure, such as might occur due to the variations in the mechanical properties of wood used in spars 6.

Double spreaders 12 and single spreader 13 in FIG. 9 are located above the upper surface of sail 4 and do not bear on sail 4, except possibly locally near spars 6, so that sail 4 in flight has a moderate dihedral angle and a moderate degree of billowing curvature in each side vertical section.

Streamer 14 may be used for appearance or for dynamic effects, either stabilizing or de-stabilizing, but is ordinarily to be avoided in serious kite uses because of the aerodynamic drag which it causes. Streamer 14 may be used simultaneously with trimmer 10, without destroying the trimming action of trimmer 10, in a construction as shown in FIG. 11.

Tape 15 is a pliable, deformable, construction tape used to join parts of the kite in various locations.

I claim:

1. A kite comprising a pliable lifting sail; a structural wing spar sloping outwardly and rearwardly on one side of said kite, lying along a substantial portion of the leading edge of said sail on that side of said kite; a generally quadrilateral pliable keel attached along its upper edge to said sail, the upper edge of said keel being concave upwardly, the length of the lower edge of said keel being longer than the greatest width top-to-bottom of said keel; a stiff keel support beam attached along the lower edge of said keel, the center of length of said keel support beam lying substantially rearward of the center of length of the structural wig spar lying along one side of the leading edge of said sail; and a flying line attached to said keel support beam at a point forward of the midpoint of said beam and rearward of the front end of said beam.

2. In claim 1, said kite being pliant and flexible in the region rearward of the region of greatest concavity of the upper edge of said keel, this portion of the kite being restrained from rising by said pliable keel in tension, said keel in turn being restrained from rising by said stiff keel support beam attached along its lower edge, said keel support beam being restrained from rising by said flying line in tension.

3. In claim 1, the upper edge of said keel having its region of greatest concavity located close to, generally above, and somewhat rearward of, the point of attachment of said flying line on said keel support beam.

4. In claim 1, a stress-carrying reinforcement attached to said keel, crossing said keel in a top-to-bottom position from the region of the greatest concavity of the upper edge of said keel to the region of the point of attachment of said flying line on said keel support beam.

5. In claim 1, a bendable surface attached to said pliable keel, adjacent to the rear end of said keel support beam, adjustable to sidewardly angling positions relative to said keel, forming an adjustable trimming surface, said trimming surface acting in combination with said keel support beam and said upwardly concave upper edge of said keel to permit aerodynamic trim adjustments in yaw of said keel relative to said sail.

6. A kite comprising a pliable lifting sail said sail being generally symmetrical on its two lateral sides, a structural wing spar sloping outwardly and rearwardly on one side of said kite, lying along a substantial portion of the leading edge of said sail on that side of said kite, one of said structural wing spars supporting the left leading edge and another of said structural wing spars supporting the right leading edge of said sail, a first horizontal spreader strut attached at each of its two ends to each of the two said structural wing spars, said first horizontal spreader strut being attached slopingly, that is, more forwardly attached to the structural wing spar on one side of the kite than to the leading edge spar on the other side of the kite, and a second horizontal spreader strut slopingly attached in the same way but with opposite slope, so that the two spreader struts cross each other, the combination of said spreaders forming an "x".

* * * * *